US012133578B1

(12) United States Patent
Tseng

(10) Patent No.: US 12,133,578 B1
(45) Date of Patent: Nov. 5, 2024

(54) MAGNETIC BUCKLE

(71) Applicant: Duraflex Hong Kong Limited, Hong Kong (CN)

(72) Inventor: Ming Yen Tseng, Taipei (TW)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 18/210,759

(22) Filed: Jun. 16, 2023

(51) Int. Cl.
*A44B 11/25* (2006.01)

(52) U.S. Cl.
CPC ..... *A44B 11/258* (2013.01); *A44D 2203/00* (2013.01); *Y10T 24/32* (2015.01)

(58) Field of Classification Search
CPC ... A45C 13/1069; A41F 1/002; A44B 11/258; Y10T 24/32; A44D 2203/00
See application file for complete search history.

(56) References Cited

U.S. PATENT DOCUMENTS

| | | | | |
|---|---|---|---|---|
| 6,292,985 | B1 | 9/2001 | Grunberger | |
| 9,101,185 | B1 | 8/2015 | Greenberg | |
| 9,635,919 | B2 * | 5/2017 | Fiedler | A45C 13/10 |
| 10,085,521 | B2 | 10/2018 | Chen et al. | |
| 10,143,270 | B2 | 12/2018 | Fiedler et al. | |
| 10,376,022 | B2 | 8/2019 | Duncan et al. | |
| D917,333 | S | 4/2021 | Duncan et al. | |
| 11,160,330 | B1 | 11/2021 | Tseng | |
| 2012/0044031 | A1 * | 2/2012 | Ninomiya | A44C 5/2085 335/219 |
| 2013/0011179 | A1 * | 1/2013 | Fiedler | A45C 13/10 403/49 |
| 2013/0269629 | A1 * | 10/2013 | Holt, Jr. | A44B 11/2584 24/303 |
| 2019/0357641 | A1 | 11/2019 | Duncan et al. | |
| 2020/0229547 | A1 * | 7/2020 | LeMarbe | A44B 11/005 |
| 2021/0307457 | A1 * | 10/2021 | Schapson | A44B 18/0073 |
| 2023/0329399 | A1 * | 10/2023 | Zook | A44B 11/2561 |
| 2023/0380547 | A1 * | 11/2023 | Paik | A44B 11/258 |
| 2024/0172844 | A1 * | 5/2024 | Lavigne | A44B 11/25 |

FOREIGN PATENT DOCUMENTS

| | | | |
|---|---|---|---|
| CN | 1555234 | A | 12/2004 |
| CN | 205214395 | U | 5/2016 |
| DE | 10 2018 121 771 | A1 | 3/2020 |
| FR | 2861553 | A1 | 5/2005 |
| WO | 03/005847 | A1 | 1/2003 |

* cited by examiner

*Primary Examiner* — Robert Sandy
*Assistant Examiner* — Michael S Lee
(74) *Attorney, Agent, or Firm* — Collard & Roe, P.C.

(57) ABSTRACT

A buckle assembly has a first buckle portion that cooperates with a second buckle portion. Each of the buckle portions has a main buckle body with two lateral sides and a magnet disposed in a magnet housing. A fastening hook is disposed on one lateral side, with a fastening opening and guide surface disposed on the opposite lateral side. Placing the interior surfaces of the buckle portions against each other causes the magnets to engage each other with magnetic attraction, and the fastening hooks of each buckle portion to enter the fastening openings of the other buckle portion, to lock the two buckle portions together. The buckle portions are disengaged by sliding the buckle portions in opposite lateral directions, perpendicular to the longitudinal extent of the buckle assembly, so that the fastening hooks slide along the opposing guide surface and force the magnets apart.

7 Claims, 6 Drawing Sheets

MAGNETIC BUCKLE

BACKGROUND OF THE INVENTION

1. Field of the Invention

This invention relates to a magnetic buckle. In particular, the invention relates to a two-piece sliding buckle that is held in place by cooperating magnets on each of the pieces, and which can be easily disassembled by sliding the parts in a direction transverse to the tension direction and transverse to the attraction direction of the magnets.

2. The Prior Art

Two-piece buckles are often used to connect two straps together, such as in a seat belt. Often, the buckles are locked together via a spring-loaded latching mechanism, which can be released by raising or lowering a latch, or by pressing a button.

Magnets have been added to these buckles to enable faster and more secure attachment of the buckle parts to each other. For example, U.S. Pat. No. 11,160,330 by the inventor of the present application discloses a two-piece buckle assembly having magnets on each of the parts, to hold the parts together, along with fastening hooks on each of the buckle parts that cooperate with fastening openings on the opposition buckle part to prevent disengagement under tension. Fastening wedges are disposed opposite the fastening hooks to prevent sliding of the buckle parts. Each of the fastening hooks are located on a longitudinal end of the buckle base body, with the longitudinal direction corresponding to the tensioning direction of the buckle. While this provides a secure and effective way to prevent inadvertent disengagement of the buckle, the arrangement of the locking hooks on the longitudinal ends requires that the parts be disengaged by sliding the buckle parts longitudinally. This can be awkward or difficult in certain applications, such as in use on a helmet strap, and requires the buckle to have extra length to accommodate the hooks in the longitudinal direction.

SUMMARY OF THE INVENTION

It is an object of the invention to provide a two-piece buckle assembly that is simple to engage and disengage in confined spaces, has a compact structure, and which does not require moving parts, such as springs or hinges, yet remains secure under tension.

This and other objects are accomplished by a buckle assembly having a first buckle portion that cooperates with a second buckle portion. Each of the buckle portions has a base body with a plurality of exterior surfaces, a plurality of interior surfaces, a first lateral side and a second lateral side. A magnet housing enclosing a magnet is disposed in the base body between the two lateral sides. A first fastening hook is disposed on the first lateral side of the first base body and projects from the interior surface of the first base body. A first fastening opening and a first guide surface are disposed on the second lateral side of the first base body. Similarly, the second buckle portion is formed by a second base body with a plurality of exterior surfaces, a plurality of interior surfaces and a first lateral side and a second lateral side. A magnet housing enclosing a magnet is disposed in the second base body between the two lateral sides. A second fastening hook is disposed on the first lateral side of the second base body and projects from the interior surface of the second base body. A second fastening opening and a second guide surface are disposed on the second lateral side of the second base body.

The first and second buckle portions are configured such that placing the interior surfaces of the first buckle portion against the interior surfaces of the second buckle portion causes the magnets to engage each other with magnetic attraction, and forces the fastening hooks of each buckle portion to enter the fastening openings of the other buckle portion, to lock the two buckle portions together and prevent disengagement under tension in opposing directions parallel to a longitudinal extent of the buckle assembly. The attractive force of the magnets serves to align the fastening hooks with the fastening openings even when the buckle portions are not placed exactly in the locking position. While the fastening hooks are in the fastening openings, forces in the longitudinal direction cannot move the hooks out of the openings, so that the buckle assembly stays locked, even under high tension in the longitudinal direction. This arrangement forms a balanced two-way load-bearing structure when buckled, and also significantly shortens the length of the buckle as compared to placing the fastening hooks on the longitudinal ends. The fixing direction is perpendicular to the bearing (tensile force) direction so that excessive forces by straps connected to the buckle cannot disengage the buckle.

However, the buckle assembly can be easily disengaged by sliding the buckle portions in opposite lateral directions, perpendicular to the longitudinal extent of the buckle assembly, so that the first fastening hook slides along the second guide surface and the second fastening hook slides along the first guide surface and forces the first and second magnets apart, breaking the magnetic attraction of the buckles. In essence, the disengagement takes place by sliding the buckle portions across one another, so that the hooks travel over the guide surface until the magnetic attraction of the magnets is broken. Preferably, each of the guide surfaces forms a slanted surface, that slants upward from the fastening opening, so that the opposing fastening hook slides along the slanted surface and travels out of the fastening opening and causes the magnets to move away from each other, in both the lateral direction, as well as a vertical direction, due to the upwardly slanted surface.

The guide surfaces are disposed adjacent the fastening openings, on the outer side of the opening between the opening and the second lateral side of each buckle portion, so that during disengagement, the fastening hook slides along and up the guide surface in the lateral direction.

The first fastening hook is preferably disposed offset in a longitudinal direction from the first fastening opening and the second fastening hook is offset in a longitudinal direction from the second fastening opening, so that in the locked position, the hooks are disposed offset from each other.

To allow for better positioning of the user's fingers during disengagement, the buckle portions are shaped so that the second lateral side of the first buckle portion extends beyond the first lateral side of the second buckle portion and the second lateral side of the second buckle portion extends beyond the first lateral side of the first buckle portion when the two buckle portions are connected together. This provides a pressing surface on both lateral sides of the buckle assembly where the user can position their fingers prior to pressing the buckle portions into disengagement. The user merely has to press their fingers together to cause the fastening hooks to travel along the guide surfaces and break the magnetic attraction.

Each of the first and second buckle portions has at least one strap-retaining bar connected to the base body at a longitudinal end. The strap retaining bar allows the buckle portions to be connected to other objects. When tension is applied on both longitudinal ends, the magnetic attraction between the magnets and the position of the fastening hooks in the fastening openings prevents the buckle assembly from disengaging. Only the pressing movement in the lateral direction allows for the hooks to clear the openings and the magnets to separate.

In one embodiment, the fastening hook of at least one of the buckle portions extends entirely though the base body of the other buckle portion when the buckle portions are fastened together, so that the fastening hook is visible from the exterior surface of the other buckle portion.

A cover can be connected to one of the buckle portions, to extend over and cover at least some of the plurality of exterior surfaces of the one buckle portion and/or cover the opening through which the hook extends.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE EMBODIMENTS

Figure 1:
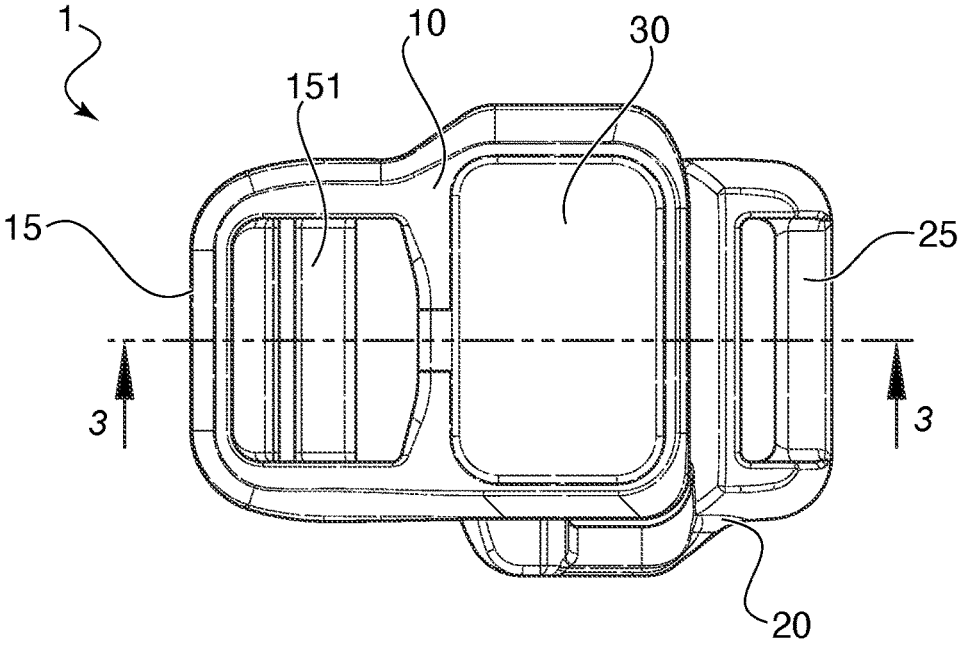
FIG. 1 shows a top view of the buckle assembly according to the invention.
Figure 2:
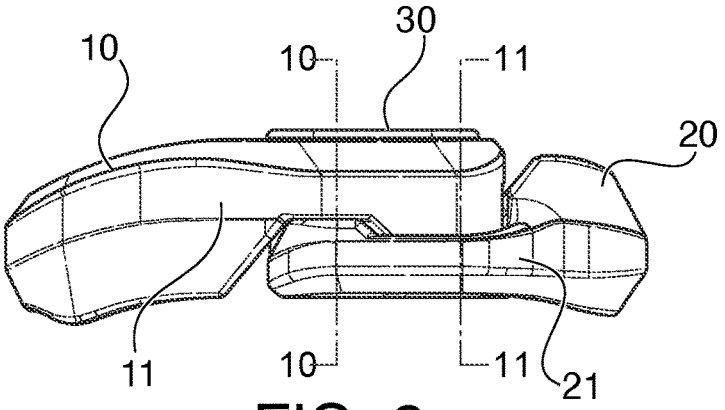
FIG. 2 shows a side view of the buckle assembly.
Figure 3:
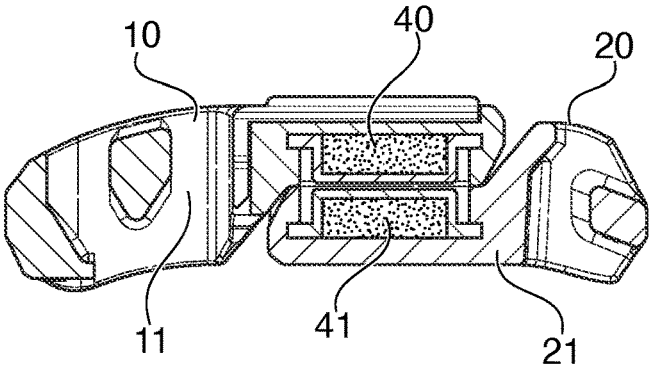
FIG. 3 shows a cross-sectional view along lines 3-3 of FIG. 1.

Referring now in detail to the drawings, FIGS. 1-3 show the buckle assembly 1 according to the invention. Buckle assembly 1 comprises a first buckle portion 10 with a base body 11 and a second buckle portion 20 with a base body 21. On their respective outer edges, which extend beyond the overlapping portions of base bodies 11, 21, are strap retaining bars 15, 25, respectively. An additional strap retaining bar 151 is also present on buckle portion 10 to allow for adjustability of straps connected thereto. Buckle portion 20 could also be equipped with additional bars if desired.

Figure 4:
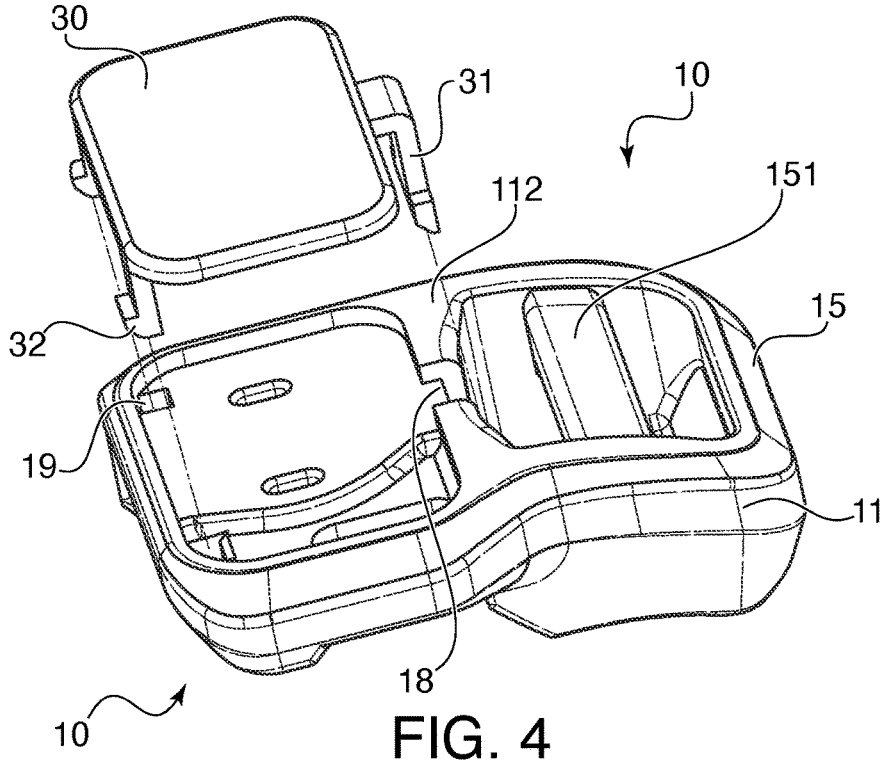
FIG. 4 shows an exploded view of the first buckle portion.
Figure 6:
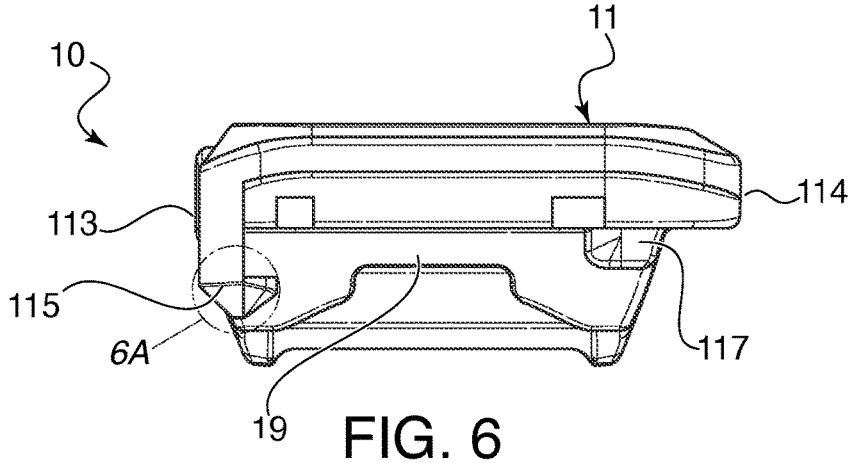
FIG. 6 shows an end view of the first buckle portion.
Figure 6A:
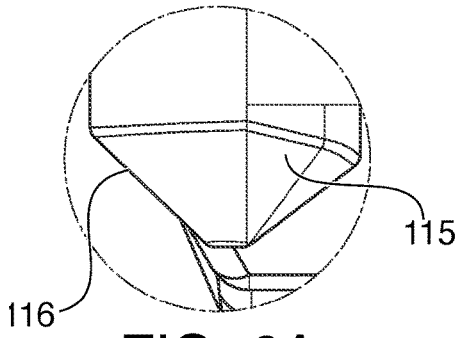
FIG. 6A shows a detail of circle 6A of FIG. 6.

A cover 30, as shown separately in FIG. 4, is connected to base body 11 of first buckle portion 10, by protrusions 32 snapping into recess 19 of base body 11. The other end of cover 30 is connected to base body 11 by snapping prong 31 into recess 18 to secure the cover immovably on base body 11.

The individual buckle portions 10, 20 are shown in detail in FIGS. 4-9. Both buckle portions can be constructed to be identical or can be made to differ in appearance and/or structure, as long as their cooperating features are intact.

Figure 5:
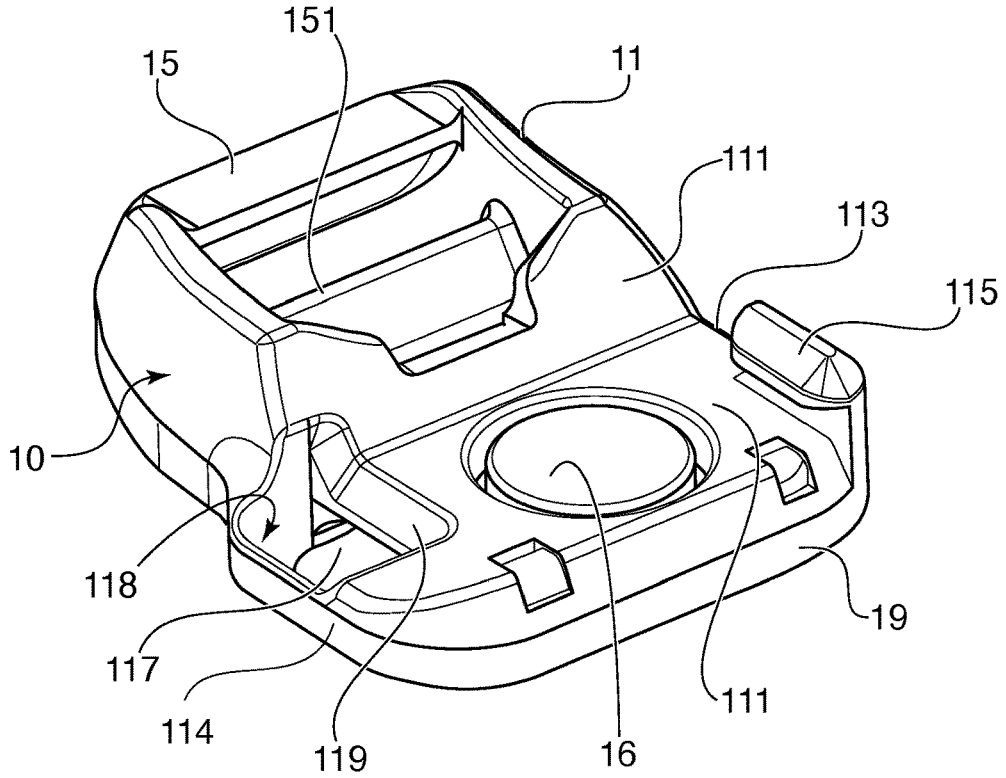
FIG. 5 shows an interior view of the first buckle portion.

First buckle portion 10 is shown in detail in FIGS. 4-6A. Base body 11 of first buckle portion 10 has a plurality of exterior surfaces 112 and a plurality of interior surfaces 111. As shown in FIG. 5, a magnet housing 16 protruding from interior surfaces 111 encases a magnet 40 therein (shown in cross-section in FIG. 3). Magnet housing 16 is disposed in base body 11, between first lateral side 113 and second lateral side 114.

A first fastening hook 115 is disposed on the first lateral side 113 and extends from an interior surface 111 of base body 11. As can be seen in in FIGS. 5-6A, first fastening hook 115 has a sloped outer surface 116. First fastening hook 115 is located at an end 19 of base body 11 that is opposite strap retaining bar 15.

Figure 10:
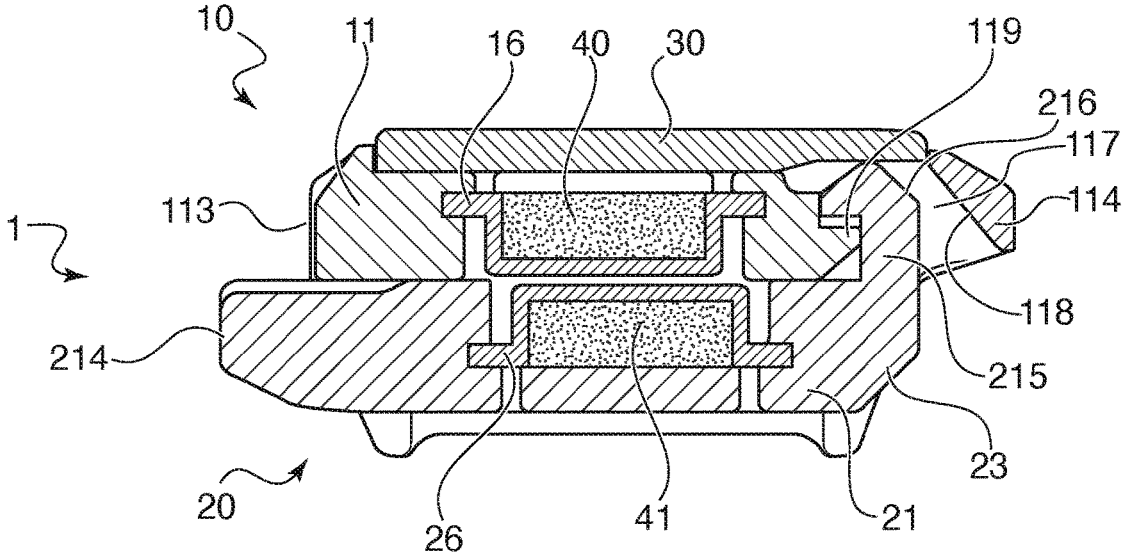
FIG. 10 shows a cross-sectional view along lines 10-10 of FIG. 2.

A first fastening opening 117 is disposed on the second lateral side 114, slightly offset in a longitudinal direction from first fastening hook 115. A first guide surface 118 is arranged adjacent first fastening opening 117 on the outer side of the opening on second lateral side 114, as seen in FIG. 10. A sloped wall 119 is disposed on the inner side of first fastening opening 117.

Figure 7:
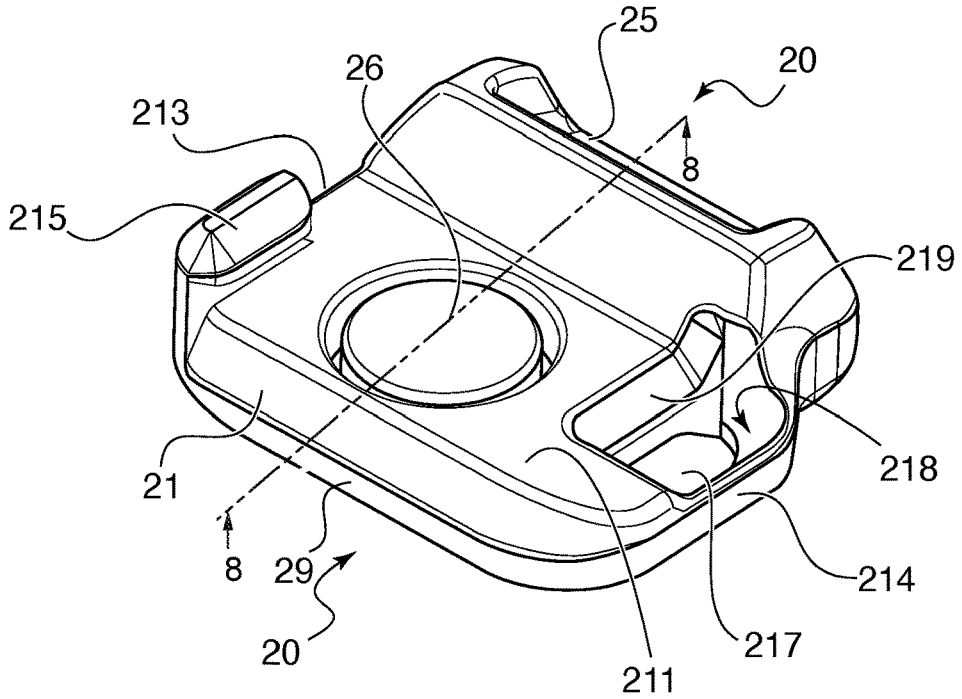
FIG. 7 shows an interior view of the second buckle portion.
Figure 8:
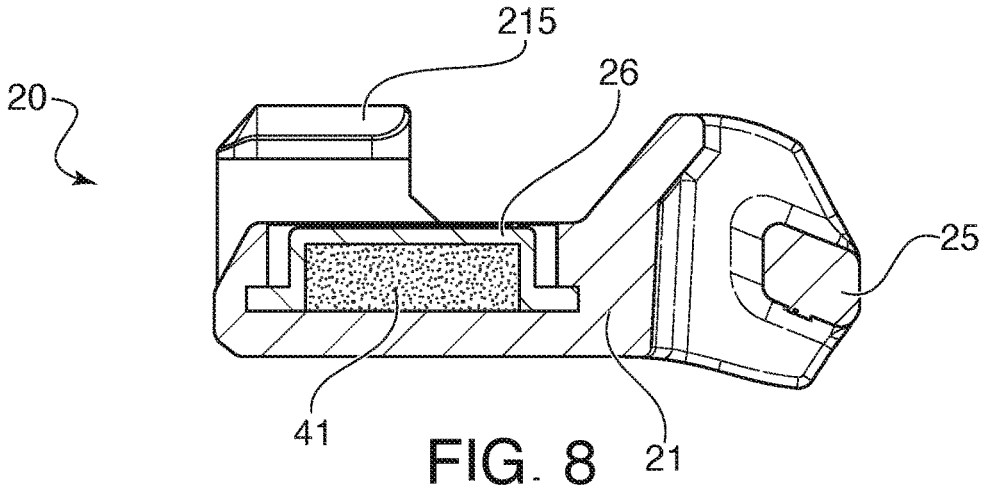
FIG. 8 shows a cross-sectional view along lines 8-8 of FIG. 7.
Figure 9:
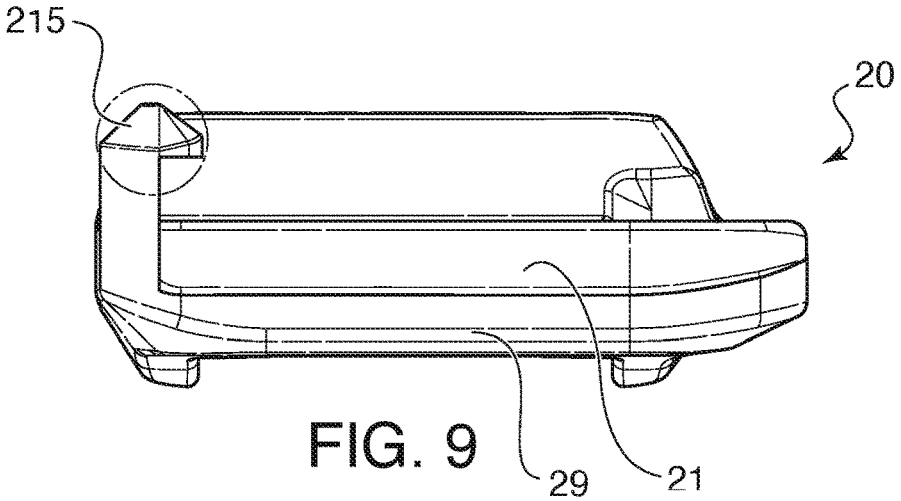
FIG. 9 shows an end vie of the second buckle portion.
Figure 9A:
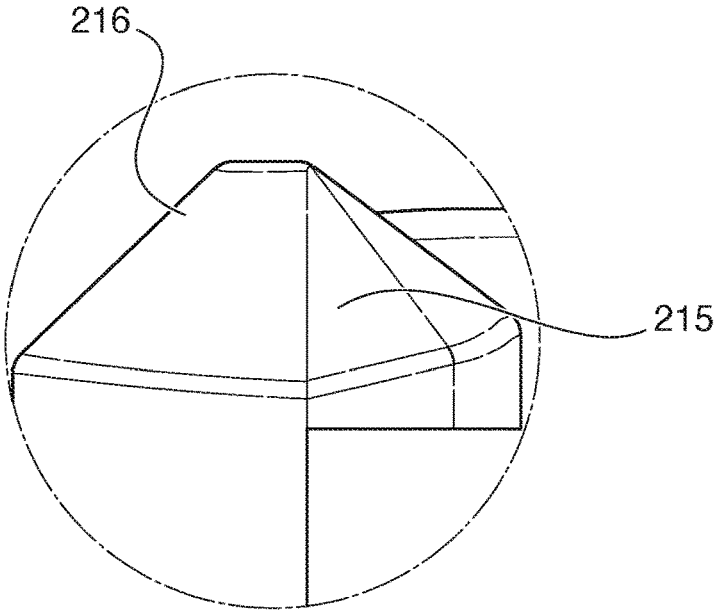
FIG. 9A shows a detail 9A from FIG. 9.

Second buckle portion 20 is shown in detail in FIGS. 7-9A. As can be seen in FIG. 7, second buckle portion 20 has a magnet housing 26, which encases a magnet 41 therein (See FIG. 3). Magnet housing 26 is disposed in base body 21 and protrudes from interior surface 211, between first lateral side 213 and second lateral side 214.

A second fastening hook 215 is disposed on first lateral side 213 and extends from interior surface 211 of base body 21. As can be seen in in FIG. 9A, second fastening hook 215 has a sloped outer surface 216. Second fastening hook 215 is located at an end 29 of base body 21 that is opposite strap retaining bar 25.

A second fastening opening 217 is disposed on the second lateral side 214, slightly offset in a longitudinal direction from second fastening hook 215. A second guide surface 218 is arranged adjacent second fastening opening 217, as seen in more detail in FIG. 11. A sloped wall 219 is disposed on the inner side of second fastening opening 217.

Figure 11:
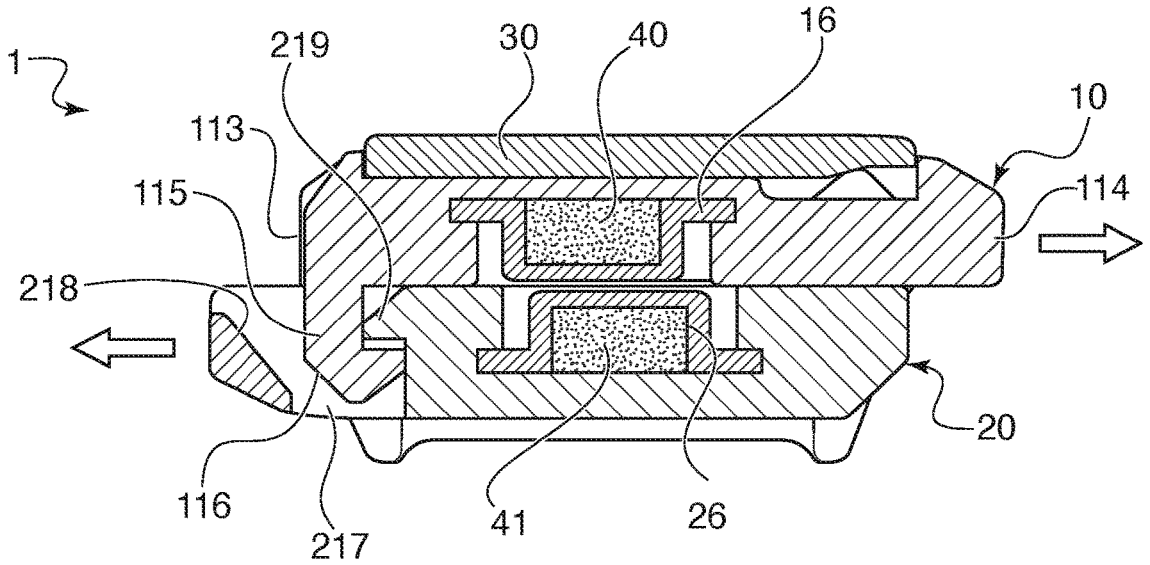
FIG. 11 shows a cross-sectional view along lines 11-11 of FIG. 2.

The buckle portions are locked together by moving the interior surfaces 111, 211 of buckle portions 10, 20, respectively, toward each other until magnets 40, 41 attract each other and press the buckle portions 10, 20 together, with the locked position of the buckle assembly being shown in FIGS. 1-3 and 10-11. At this point, first fastening hook 115 of first buckle portion 10 extends into second fastening opening 217, and hooks under wall 219 as can be seen in the cross-section of FIG. 11, and second fastening hook 215 extends into first fastening opening 117 and hooks under wall 119. The attractive force of the magnets forces the hooks toward the center of buckle assembly 10, so that they cannot be inadvertently released during use. As can be seen in FIGS. 10 and 11, magnets 40, 41 are offset from each other in the fully locked position so that a constant lateral force is applied to the buckle portions in the direction shown by the arrows in FIG. 11, to force the hooks 115, 215 to engage with the respective walls 219, 119 respectively of the opposite buckle portion. Walls 119, 219 are sloped to allow the hooks 115, 215 to slide more easily into place during assembly.

Figure 14A:
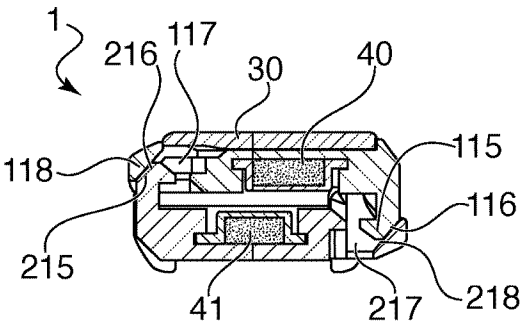
FIG. 14A shows a cross-sectional view along lines 14A-14A of FIG. 14.
Figure 13A:
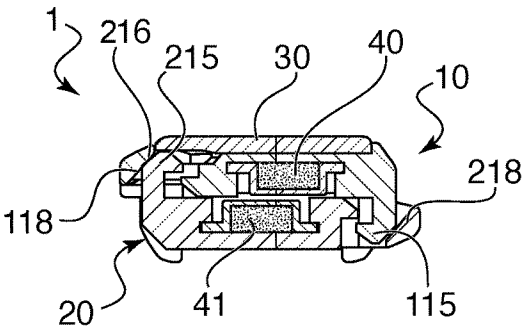
FIG. 13A shows a cross-sectional view along lines 13A-13A of FIG. 13.
Figure 12A:
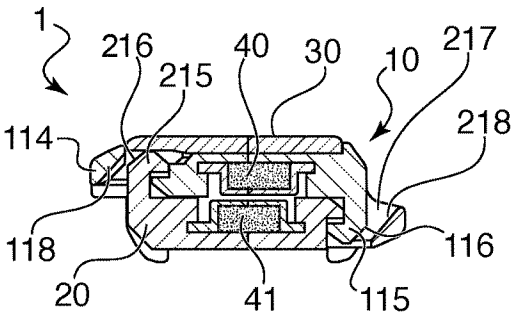
FIG. 12A shows a cross-sectional view along lines 12A-12A of FIG. 12.
Figure 14:
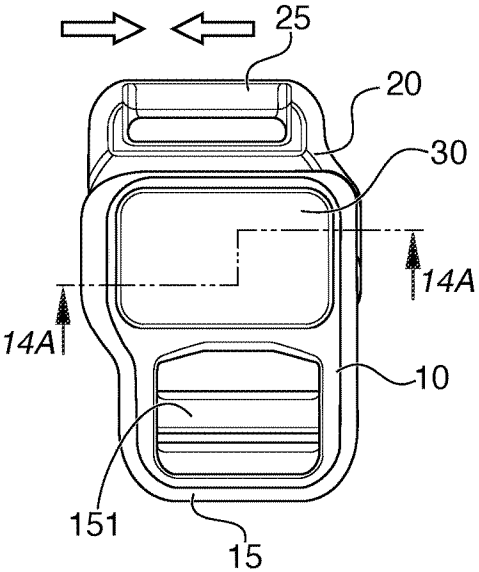
FIG. 14 show a top view of the buckle assembly at the completion of the disengagement action.
Figure 13:
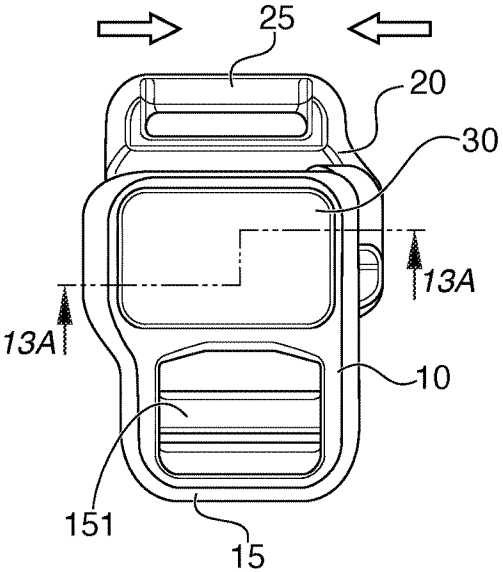
FIG. 13 shows a top view of the buckle assembly partially through a disengagement action.
Figure 12:
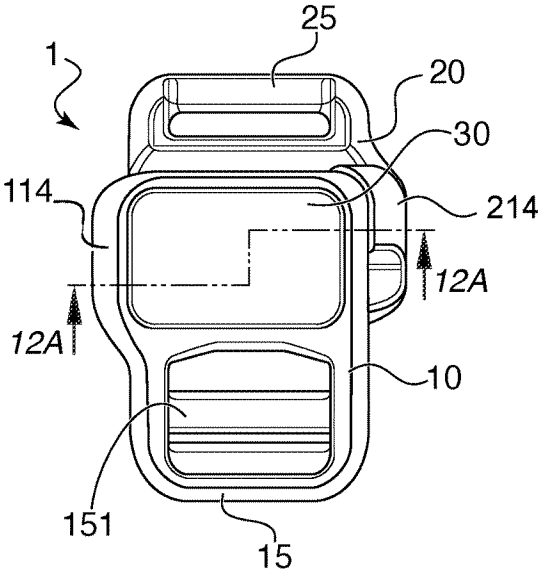
FIG. 12 shows a top view of the buckle assembly in a locked configuration.

The operation of buckle assembly 1, from moving the buckle portions 10, 20 from the fully locked position to a releasable position is shown in FIGS. 12-14 and their respective cross-sectional views 12A-14A. The cross-sections cut across the parts of the buckle assembly containing each of the hooks, so that rather than a straight cross-section, an offset cross section as indicated by lines 12A-12A, 13A-13A and 14A-14A is shown. The straight cross-sectional views are shown in FIGS. 10 and 11.

The fully locked position is shown in FIGS. 12 and 12A. Here, the second lateral side 114 of first buckle portion 10 extends outward and overlaps the first lateral side 213 of second buckle portion 20, and the second lateral side 214 of second buckle portion 20 overlaps the first lateral side 113 of first buckle portion 10. To disengage the buckle portion 10, 20, the user presses the overlapping lateral sides 114, 214 toward each other, causing the sloped outer surfaces 116, 216 of hooks 115, 215 to engage sloped guide surfaces 118, 218, as shown in FIG. 13A. Further pressing of the overlapping sides 114, 214 causes the sloped surfaces 116, 216 of hooks 115, 215 to slide along sloped guide surfaces 118, 218 as shown in FIGS. 14 and 14A until magnets 40, 41 are forced apart, and the attractive force between the two magnets 40, 41 is broken, as seen in FIG. 14A, thus allowing separation of first buckle portion 10 from second buckle portion 20.

The attractive force of the magnets ensures simple and reliable engagement of the buckle portions to each other, especially in tight situations where the user may not be able to see the buckle while using it. The magnets also keep the buckle portions engaged in the locked position under tension from straps. When straps are wrapped around strap retaining bars 15, 25, the magnets prevent buckle portions 10, 20 from flipping over due to magnetic attraction between their exterior surfaces 112 and 212 during engagement of the buckle portions. The hook construction combined with the magnetic attraction also prevents separation of the buckle portions from one another in the vertical direction, unless the sliding action shown in FIGS. 12-14A is undertaken first. The location of the hooks on the lateral sides allows for a very compact buckle construction, which is especially useful for certain applications having limited space for the buckle.

The present invention provides a simple and secure way to attach two buckle parts together, without requiring a large amount of force to disengage the parts and without requiring any moving parts in the buckle. The configuration of the present invention allows for simple disengagement of the buckle portions using only two fingers, even in tight spaces and under high tension, such as in use on a helmet strap.

Accordingly, while only a few embodiments of the present invention have been shown and described, it is obvious that many changes and modifications may be made thereunto without departing from the spirit and scope of the invention.

What is claimed is:

1. A buckle assembly comprising:

a first buckle portion comprising a first base body with a plurality of exterior surfaces, a plurality of interior surfaces, a first lateral side and a second lateral side, a magnet housing enclosing a magnet, a first fastening hook on the first lateral side of the first base body, and a first fastening opening and a first guide surface on the second lateral side of the first base body; and a second buckle portion comprising a second base body with a plurality of exterior surfaces, a plurality of interior surfaces and a first lateral side and a second lateral side, a magnet housing enclosing a magnet, a second fastening hook on the first lateral side of the second base body, and a second fastening opening and a second guide surface on the second lateral side of the second base body;

wherein the first guide surface is disposed adjacent the first fastening opening, between the first fastening opening and the second lateral side of the first buckle portion, and the second guide surface is disposed adjacent the second fastening opening, between the second fastening opening and the second lateral side of the second buckle portion, wherein the first and second buckle portions are configured such that placing the interior surfaces of the first buckle portion against the interior surfaces of the second buckle portion causes the magnets to engage each other with magnetic attraction, and the fastening hooks of each buckle portion to enter the fastening openings of the other buckle portion, to lock the two buckle portions together and prevent disengagement under tension in opposing directions parallel to a longitudinal extent of the buckle assembly, and wherein the buckle portions are configured to be disengaged by sliding the buckle portions in opposite lateral directions, perpendicular to the longitudinal extent of the buckle assembly, so that the first fastening hook slides along the second guide surface and the second fastening hook slides along the first guide surface and forces the first and second magnets apart, breaking the magnetic attraction of the buckles.

2. The buckle assembly according to claim 1, wherein each of the guide surfaces comprises a slanted surface, so that the opposing fastening hook slides along the slanted surface during disengagement of the buckle portions from each other.

3. The buckle assembly according to claim 1, wherein the first fastening hook is disposed offset in a longitudinal direction from the first fastening opening and the second fastening hook is offset in a longitudinal direction from the second fastening opening.

4. The buckle assembly according to claim 1, wherein the buckle portions are shaped so that the second lateral side of the first buckle portion extends beyond the first lateral side of the second buckle portion and the second lateral side of the second buckle portion extends beyond the first lateral side of the first buckle portion when the two buckle portions are locked together.

5. The buckle assembly according to claim 1, wherein each of the first and second buckle portions have at least one strap-retaining bar connected to the base body at an end opposite the respective fastening hooks, the at least one strap retaining bar being configured to allow the buckle portions to be connected to other objects.

6. The buckle assembly according to claim 1, wherein the fastening hook of at least one of the buckle portions extends entirely though the base body of the other buckle portion when the buckle portions are fastened together, so that the at least one fastening hook is visible from the exterior surface of the other buckle portion.

7. The buckle assembly according to claim 1, further comprising a cover connected to one of the buckle portions, the cover extending over at least some of the plurality of exterior surfaces of the one buckle portion.

* * * * *